United States Patent [19]

Takahashi et al.

[11] 4,064,677

[45] Dec. 27, 1977

[54] MICROFILM INSERTER

[75] Inventors: Yutaka Takahashi; Yoshio Hakamata, both of Tokyo; Masamitu Konno, Hino, all of Japan

[73] Assignee: Fuji Photo Film Co., Ltd., Minami-ashigara, Japan

[21] Appl. No.: 770,041

[22] Filed: Feb. 18, 1977

[30] Foreign Application Priority Data

Feb. 20, 1976 Japan ..... 51-17513

[51] Int. Cl.[2] ..... B65B 61/06

[52] U.S. Cl. ..... 53/123; 83/167; 83/424

[58] Field of Search ..... 53/123; 83/167, 424; 29/806

[56] References Cited

U.S. PATENT DOCUMENTS

| | | | |
|---|---|---|---|
| 2,892,295 | 6/1959 | McArthur | 53/123 |
| 3,872,645 | 3/1975 | Dorman | 53/123 |

*Primary Examiner*—Travis S. McGehee
*Attorney, Agent, or Firm*—Fleit & Jacobson

[57] ABSTRACT

A microfilm inserter having a table for retaining a microfilm jacket in a fixed position is provided with a pair of feed rolls at either end of the table, a detecting means for detecting the trailing end of a microfilm strip to be inserted into said jacket, and a cutter for cutting off the leader of said microfilm strip. A film strip having a leader is fed through the feed rolls at one end and into the insertion slot of the jacket. When the leader exits from the far end of the jacket, it passes between the other pair of rolls and the film strip continues to be transported even after the trailing end thereof has passed through the feed rolls at said one end. When it is detected that the trailing end of the film strip has arrived at a predetermined position, the film strip is stopped and the leader is cut off along the far end of the jacket.

8 Claims, 4 Drawing Figures

MICROFILM INSERTER

BACKGROUND OF THE INVENTION

1. Field of the Invention

This invention relates to an improved inserter for microfilm strips and more particularly to an inserter for inserting microfilm strips into jackets wherein the microfilm strips are cut flush with the jackets at their leading ends.

2. Description of the Prior Art

Microfilm strips ordinarily have either a blank leader or a blank trailer. In the conventional microfilm inserter (hereinafter called simply an "inserter"), the film strip is first inserted into the jacket and the trailer is then cut along the end of the jacket to obtain a strip of proper length.

However, the slot in the jacket for insertion of the film strip is somewhat inset from the end of the jacket and, therefore, the conventional method of cutting the film strip along the end of the jacket makes necessary an additional positional adjustment wherein the end of the film is pushed inward until it reaches the insertion slot.

SUMMARY OF THE INVENTION

In light of the foregoing observations and description of the conventional inserter, the primary object of the present invention is to provide an inserter wherein the trailing end of the film strip is inserted as far as the insertion slot of the jacket and the leading end is thereafter cut off so that the length of the film strip properly matches that of the jacket.

Another object of the present invention is to provide an inserter which operates automatically.

The above mentioned objects of the present invention are accomplished by the present invention in the manner described below.

The inserter in accordance with the present invention is provided with a table for holding the jacket in a fixed position and two pairs of feed rolls located in corresponding positions at opposite ends of the table. The feed rolls at one end of the table feed the film strip into the insertion slot of the jacket and continue to transport the film strip through the jacket until its leading end emerges from the far end and enters the other pair of feed rolls. When the trailing end of the film strip reaches the insertion slot, the film strip is stopped and its leader is cut off flush with said far end of the jacket. At this time the film strip is properly positioned within the jacket so that no further positional adjustment is necessary. The present invention thus simplifies the operation of inserting the film strip into the jacket.

DESCRIPTION OF THE PREFERRED EMBODIMENTS

Figure 1:
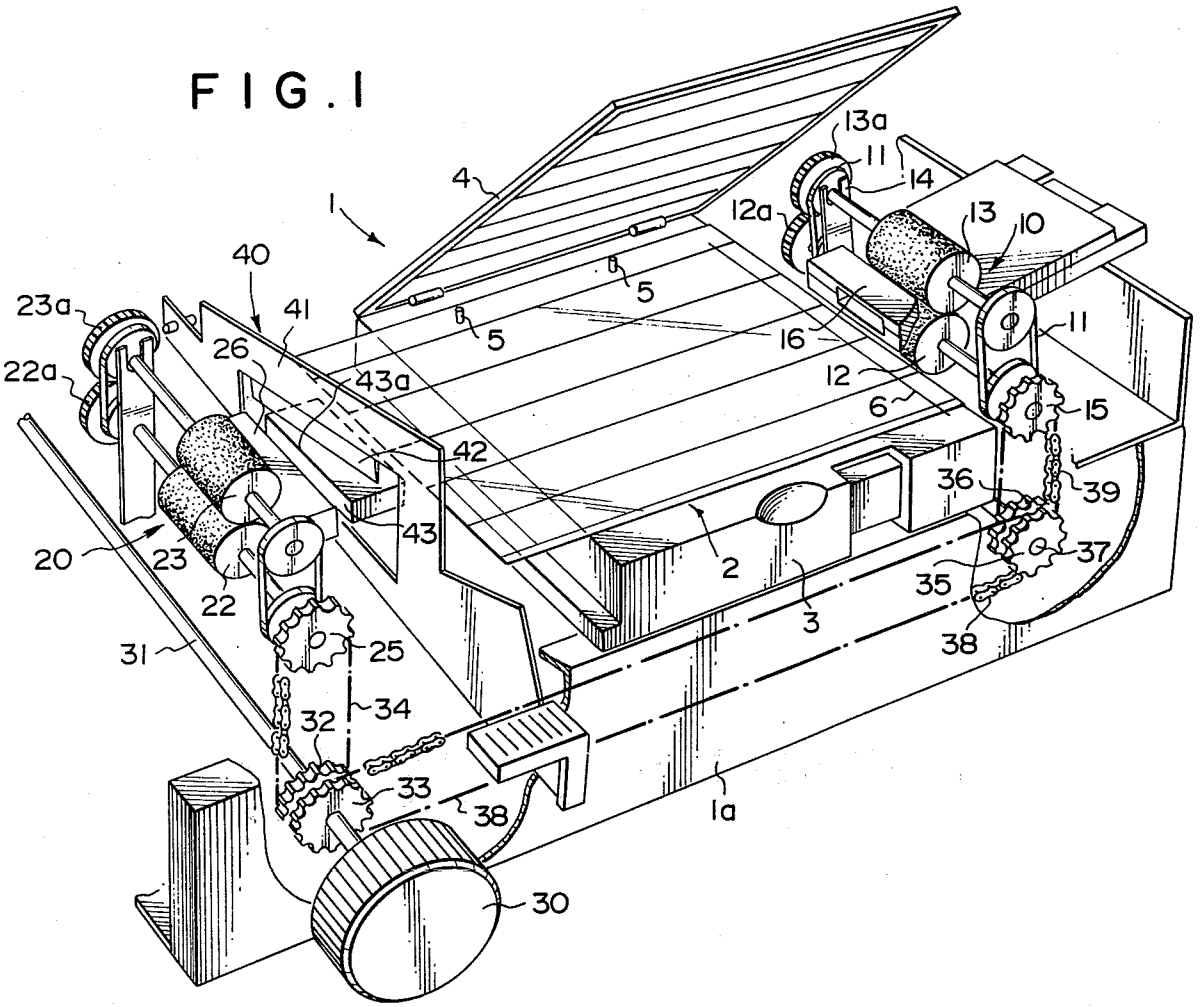
FIG. 1 is a partially broken-away perspective view of one embodiment of the inserter of the present invention.

Referring to FIG. 1 which shows a partially brokenaway perspective view of the inserter in accordance with an embodiment of the invention, a table 3 for supporting a jacket 2 in a fixed position is provided between two opposing pairs of feed rolls, namely, a pair of first feed rolls 10 and a pair of second feed rolls 20. The inserter further comprises a drive knob 30 for mechanically driving the two pairs of feed rolls 10, 20 and a cutter 40 positioned between the rolls 20 and one end of the table 3.

The table 3 is provided with jacket retaining plate hinged to open and close and with two positioning pins 5 for engaging two positioning holes 51 (FIG. 2) in the jacket 2 and thereby holding the jacket in a fixed position.

The first feed rolls 10 are comprised of a lower roller 12 and an upper roller 13 located directly over and in parallel with the lower roller 12 and held in contact therewith by a pair of endless rubber belts 11. The shafts of the rollers 12 and 13 are rotatably supported by a bearing 11 and are linked via a gear **12*a* at the end of the shaft of the roller 12 and a gear 13*a* at the end of the shaft of the roller 13. A sprocket 15 is provided on the shaft of the roller 12 at the end opposite that on which the gear 12*a*** is provided.

The second feed rolls 20 are identical in construction with the first feed rolls 10 and the corresponding elements thereof are indicated by reference numerals which are greater by ten than those of the first feed rolls 10.

The drive knob 30 has a shaft 31 rotatably supported by the inserter chassis **1*a* in the vicinity of the second feed rolls 20. The shaft 31 has two sprockets 32, 34 fixed thereon. The sprocket 32 is linked to the sprocket 25 by a chain 34. A pair of sprockets 35, 36 are fixed to a shaft 37 rotatably supported by the chassis 1*a* in the vicinity of the first feed rolls 10. The sprocket 35 is linked by a chain 38 with the sprocket 33 fixed on the shaft 31 associated with the drive knob 30. The sprocket 36 is linked by a chain 39 with the sprocket 15 associated with the first feed rolls 10**.

A film guide 16 is provided between the first feed rolls and the table 3 to guide the film strip passing between said rolls into the insertion slot of the jacket 2 and another film guide 26 is provided between the table 3 and the second feed rolls 20 to guide the leader of the film strip between the second feed rolls 20.

The cutter 40 situated between the table 3 and the second feed rolls 20 is comprised of a cutter arm 40 pivotally supported so as to be free to swing in a plane perpendicular to that of the face of the table 3, a blade 42 attached to the cutter arm 41 and a stationary blade 43 having a shearing edge **43*a* aligned with the exit 52 (FIG. 2) of the jacket 2**.

The table 3 is made slidable in the direction perpendicular to that in which the film strips are transported by the feed rolls 10, 20 so that any desired one of strip holders **53*a* –53*e* can be brought into alignment with the two film guides 16, 26. Near the right edge of the table 3 is a reference line 6 marking the position of the insertion slots 54, which is also the position at which the trailing end 62*a* of the film strip 60** is to be stopped.

Figure 2:
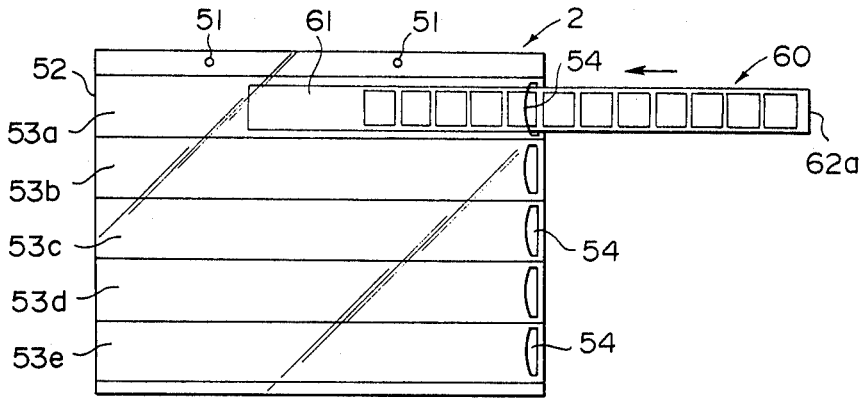
FIG. 2 is a plan view of a jacket into which a film strip is being fed.
Figure 3:
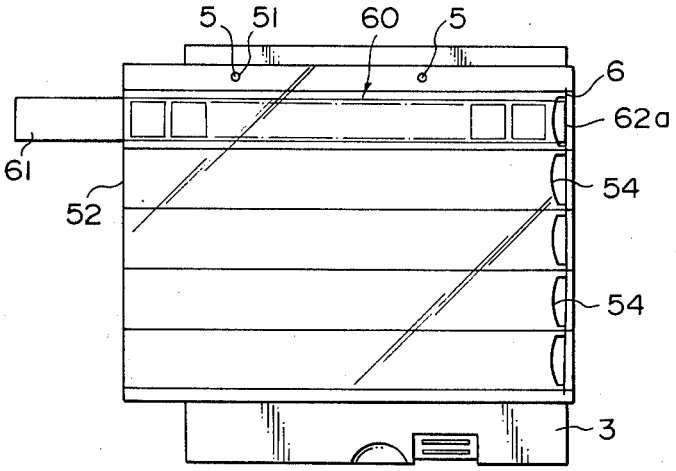
FIG. 3 is a plan view of a jacket into which a film strip has been fed up to the cutting position.

After a film strip has been fed into the inserter by a feeding means (not shown) to the right of the embodiment shown in FIG. 1, the drive knob 30 is rotated counterclockwise, rotating the sprocket 33, the sprocket 35, the sprocket 36, the sprocket 15 and, consequently, the roller 12 counter-clockwise. The roller 13 is rotated clockwise via the gears **12*a* and 13*a*. The film strip 60 is thus drawn between the rollers 12, 13 and transported toward the left entering the insertion slot 54** as shown in FIG. 2. With further rotation of the drive knob 30 in the counter-clockwise direction, the leader 61 of the film strip 60 exits from the jacket 2 at the far end 52 thereof and passes to the second feed rolls via the film guide 26. As the lower roller 22 is rotated counter-clockwise by the chain drive comprised of sprockets 32 and 25 and chain 34 and the upper roller 23 is rotated clockwise via the gears 22*a* and 23*a*, the leading end of the film strip 60 is drawn between the rollers 22, 23 so that the film continues to be transported leftward even after the trailing end thereof has passed through the first feed rolls 10. When the trailing end 62*a* reaches the reference line 6, rotation of the drive knob is stopped and the cutter 40 is operated to cut off the leader 61 along the exit 52 of the jacket 2.

Figure 4:
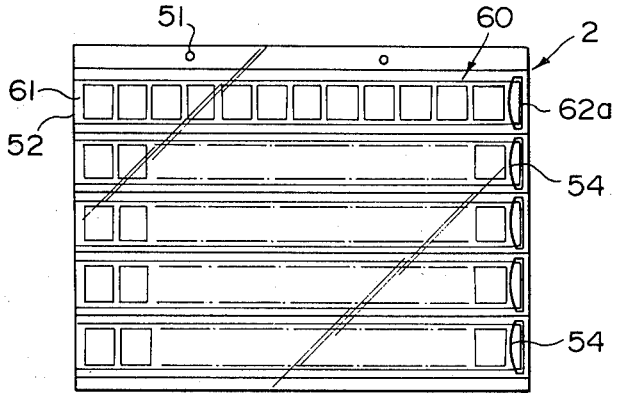
FIG. 4 is a plan view of a jacket with a film strip properly inserted.

The positional relationship between the film strip and the jacket after the cutting operation is shown in FIG. 4. As can be seen, the film strip is properly positioned with the jacket so that it is not necessary to conducted an additional positional adjustment as is necessary in conventional inserters.

In the manually operated inserter just described, the drive knob 30 is rotated until the trailing end 62*a* of the film 60 comes into alignment with the reference line 6 and the cutter is then operated by hand to cut off the leader. It is, however, possible to drive the feed rolls 10, 20 by a motor and replace the reference line 6 by an optical or electrical detecting means which, on detecting the trailing end of the film, produces a signal to stop the motor and actuate an electrical cutter so as to attain automatic operation of the inserter.

We claim:

1. A microfilm inserter comprising a table for retaining a microfilm jacket in a fixed position, first feed rolls located at one end of said table for inserting a microfilm strip into an insertion slot in said jacket, second feed rolls located at the other end of said table for further transporting said film strip after it emerges from the exit of said jacket, means for driving said first and second feed rolls, means for detecting the trailing edge of said film strip, and means for cutting off the leading portion of said film strip along the exit of said jacket when the detecting means detects the trailing end of said film strip.

2. A microfilm inserter as defined in claim 1 wherein said means for driving said first and second feed rolls is a drive knob.

3. A microfilm inserter as defined in claim 1 wherein said means for driving said first and second feed rolls is a motor.

4. A microfilm inserter as defined in claim 1 wherein said means for cutting off said leading portion is a manually operated blade.

5. A microfilm inserter as defined in claim 1 wherein said means for cutting off said leading portion is electrically actuated.

6. A microfilm inserter as defined in claim 1 wherein said detecting means is a reference line.

7. A microfilm inserter as defined in claim 1 wherein said detecting means is an optical detector.

8. A microfilm inserter as defined in claim 1 wherein said detecting means is an electrical detector.

* * * * *